United States Patent [19]

Larson et al.

[11] Patent Number: 4,689,899

[45] Date of Patent: Sep. 1, 1987

[54] LAYERED INNER SOLE

[76] Inventors: Jon Larson; Van Larson, both of 513 S. 6th St., Grand Forks, N. Dak. 58201

[21] Appl. No.: 853,934

[22] Filed: Apr. 21, 1986

[51] Int. Cl.[4] ..... A43B 13/40

[52] U.S. Cl. ..... 36/44; 36/11.5; 36/71; 128/595

[58] Field of Search ..... 36/44, 43, 71, 11.5; 128/595, 581, 586

[56] References Cited

U.S. PATENT DOCUMENTS

| | | | |
|---|---|---|---|
| 4,062,131 | 12/1977 | Hsiung | 36/44 |
| 4,129,675 | 12/1978 | Scott | 2/81 X |
| 4,461,099 | 7/1984 | Bailly | 36/44 |

FOREIGN PATENT DOCUMENTS

| | | | |
|---|---|---|---|
| 526240 | 2/1954 | Belgium | 36/43 |
| 3032941 | 4/1982 | Fed. Rep. of Germany | 36/44 |
| 2562474 | 11/1985 | France | 36/43 |
| 534138 | 2/1941 | United Kingdom | 36/44 |
| 2137866 | 10/1984 | United Kingdom | 36/43 |

*Primary Examiner*—James Kee Chi

[57] ABSTRACT

An inner sole for a shoe consisting of a layered construction having a cushioned moisture repellant bottom layer, an insulating middle layer and an overlying moisture absorbent layer which readily evaporates the retained moisture.

1 Claim, 4 Drawing Figures

LAYERED INNER SOLE

BACKGROUND OF THE INVENTION

1. Field of Invention

This invention relates to the construction of an inner sole for a shoe.

2. Description of the Prior Art

Inner soles for shoes are in common use. The purpose generally of an inner sole is to provide a cushioned walking effort. Further, in general, inner soles are of a single layer construction, they retain moisture and are adversely affected by it, they become compressed and also do not provide significant insulation.

It is desirable to have an inner sole of a construction which is resistant to compression, which readily evaporates absorbed moisture and which provides effective insulation.

SUMMARY OF THE INVENTION

It is an object of this invention to provide a layered inner sole construction representing significant improvement.

It is a further object of this invention to fabricate an inner sole having a moisture repellant bottom layer effectively able to seal out moisture from penetrating a shoe sole to the foot of the wearer.

It is another object of this invention to fabricate an inner sole having a middle layer which is compression resistant and which is an effective insulator.

It is still another object of this invention to have a top absorbent layer of an inner sole which layer will retain moisture and not pass it on and which readily permits evaporation of the retained moisture.

More specifically it is the purpose herein to fabricate a unitary layered inner sole which lends itself to providing a dry cushioned well insulating walking effort.

These and other objects and advantages of the invention will be set forth in the following description made in connection with the accompanying drawings in which like reference characters refer to similar parts throughout the seveval views.

DESCRIPTION OF A PREFERRED EMBODIMENT

Figure 1:
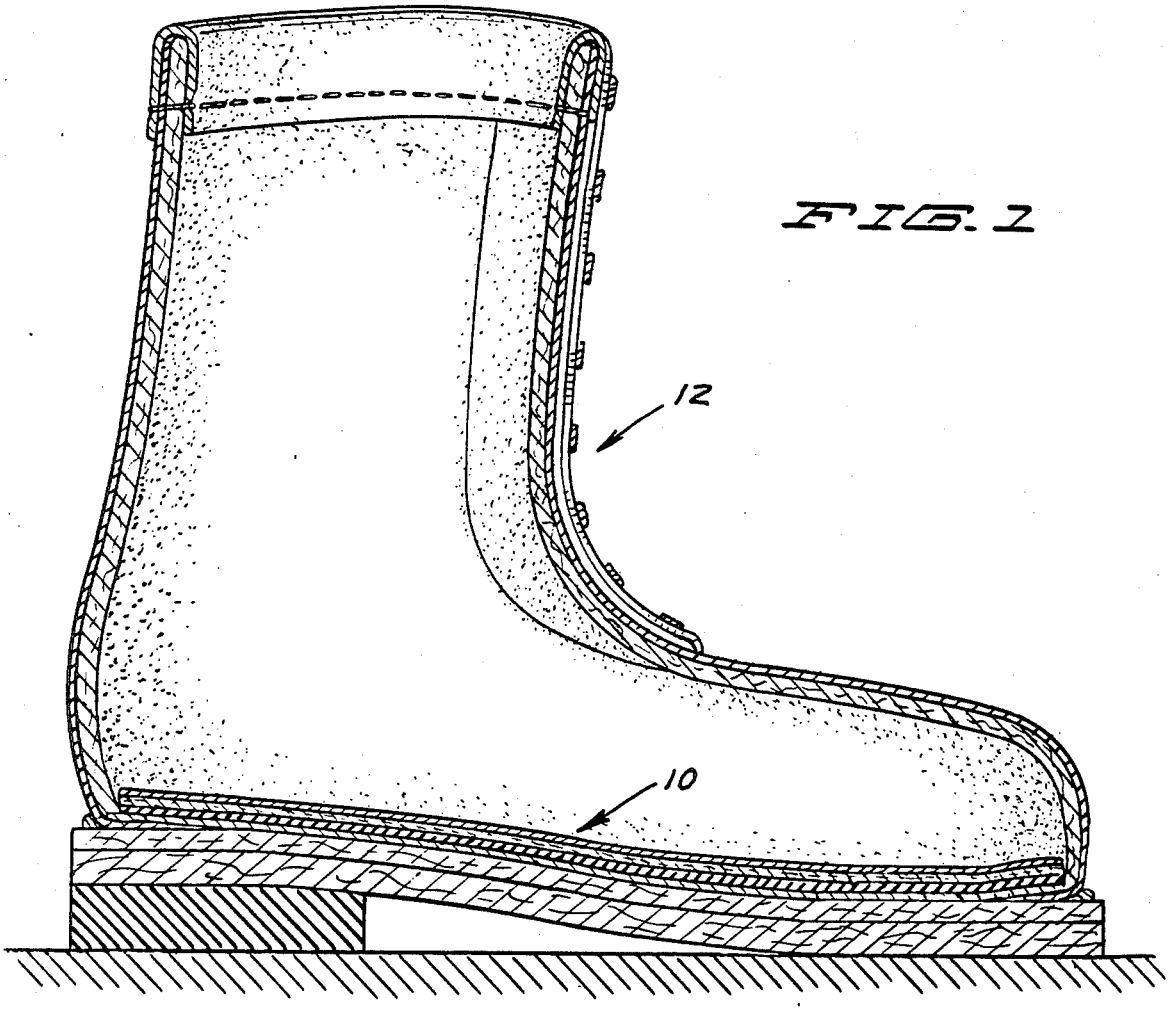
FIG. 1 is a view in vertical longitudinal section showing the invention in its use position.
Figure 2:
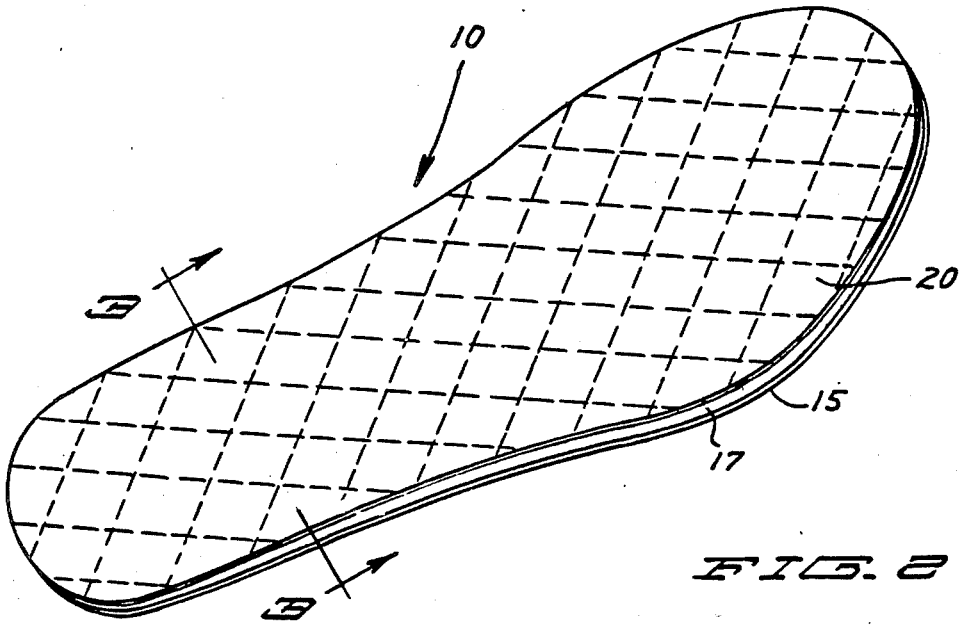
FIG. 2 is a top view in perspective.
Figure 3:
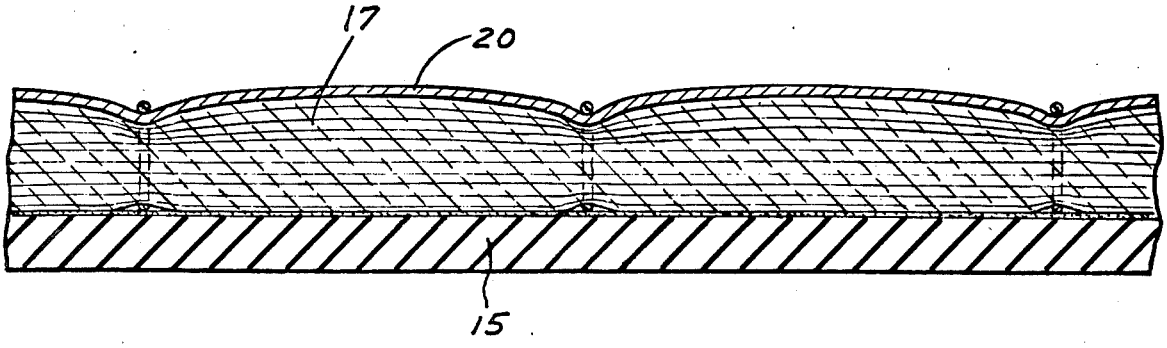
FIG. 3 is a fragmentary view, on an enlarged scale, in vertical cross section taken on line 3—3 of FIG. 2, as indicated.

Referring to FIGS. 1–3, this invention comprises an inner sole 10 shown in position as used in a boot 12, this boot being representative of shoes generally.

In FIG. 3, the layered construction of said inner sole 10 is well shown consisting of a bottom layer 15 which is a moisture repellant and cushioned layer, a middle layer 17 which is an insulating layer and a top layer 20 which is moisture absorbent.

The bottom layer 15 is very suitably made of a closed cell expanded plastic foam material of which one commercially known form is neoprene. This layer resists the passage of dampness from a shoe sole to the foot of a wearer.

The middle layer 17 is an insulating layer intended to have very good insulating properties and to resist compression and is suitably formed of polyester fibers. Commercially known products suitable for use are Thermolite made by the Dupont Company and Thinsulate made by the 3M company—these product names being well known trademarks. Thus the central layer 17 gives very effective thermal insulation.

The third and top layer 20 of said liner is formed of relatively thin material which will absorb foot moisture and retain it without passing it through itself and from which the absorbed moisture is readily evaporated. This material is suitably made of non-woven fibers providing substantial air space. A very suitable material for this purpose is one such as the material commercially well known as Cambrelle, this being a material produced by the Scott Foot Care Products Company. Cambrelle is a non-woven fibrous structural material which is very conducive to foot comfort.

The three layers described are suitably secured in superposed or layered position by the use of a suitable adhesive. The upper layer 20 is shown as a stitched fabric and it may readily be stitched to its underlying insulating layer 17.

Thus in the unitary three layered construction of said liner 10, a very desirable product has been produced.

Figure 4:
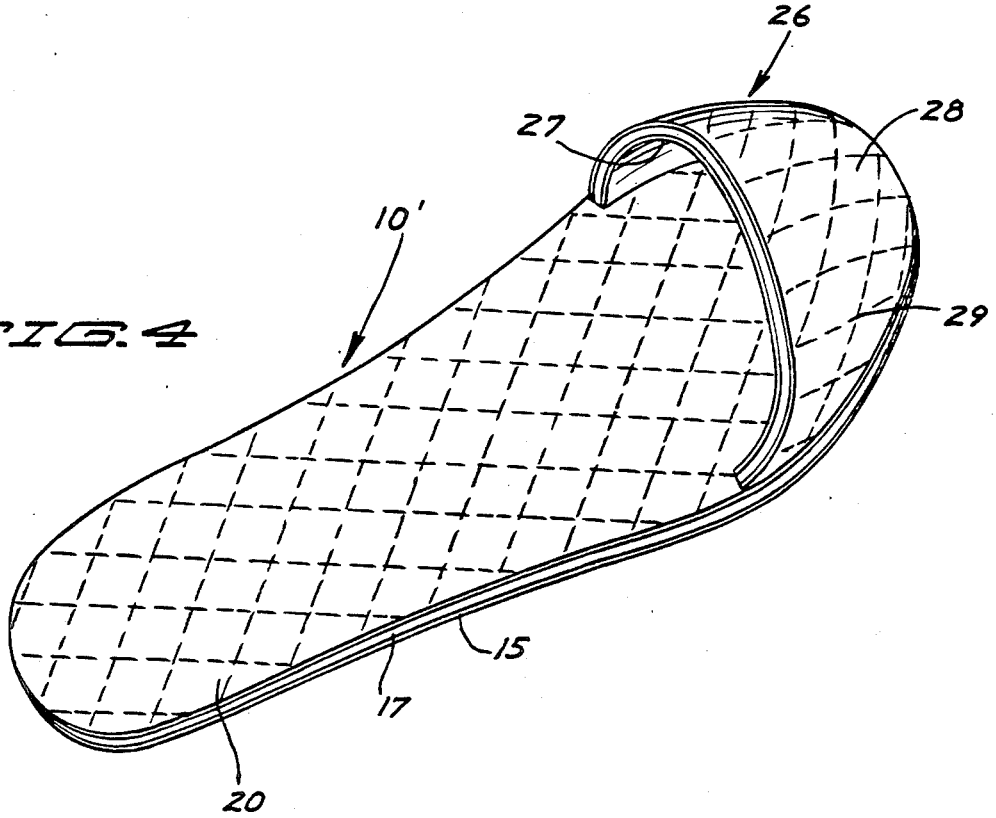
FIG. 4 is a top view in perspective showing a modification.

Referring to FIG. 4, the liner 10 is shown in a modified form 10'.

The modification consists of the addition of a toe cap 26. The other parts are as described above. Said toe cap is formed having an inner moisture absorbing layer 27 formed of a layer material such as layer 20 above described and having an outer insulating layer 28 formed of a material such as that of the layer 17 above described. Said layers 26 and 27 are shown stitched together as at 29. Said toe cap 26 may be secured to the liner 10 by a suitable adhesive or by stitching, not here shown.

The liners herein have been tested under severe weather conditions and have been found to provide the benefits claimed for them therein.

It will of course be understood that various changes may be made in the form, details, arrangement and proportions of the product without departing from the scope of the invention which, generally stated, consists in a product capable of carrying out the objects above set forth, such as disclosed and defined in the appended claims.

What is claimed is:

1. For insertion into a shoe, an inner sole of layered construction, having in combination a bottom cushion layer repellant to the penetration of moisture, compression resistant insulating central layer of a relatively non-absorbent polyester micro-fibers, and a top layer of a relatively thin non-woven highly porous absorbent non-wicking material which retains foot generated moisture until it is evaporated therefrom.

* * * * *